US006143459A

United States Patent [19]

Vizard

[11] Patent Number: 6,143,459

[45] Date of Patent: Nov. 7, 2000

[54] PHOTOSENSITIVE FILM ASSEMBLY HAVING REFLECTIVE SUPPORT

[75] Inventor: Douglas L. Vizard, Durham, Conn.

[73] Assignee: Eastman Kodak Company, Rochester, N.Y.

[21] Appl. No.: 09/467,853

[22] Filed: Dec. 20, 1999

[51] Int. Cl.[7] ..... G03C 1/95

[52] U.S. Cl. ..... 430/139; 430/502

[58] Field of Search ..... 430/139, 502

[56] References Cited

U.S. PATENT DOCUMENTS 5,021,327 6/1991 Bunch et al. ..... 430/502

5,856,075 1/1999 Jeffries et al. ..... 430/502

*Primary Examiner*—Hoa Van Le

*Attorney, Agent, or Firm*—William F. Noval

[57] ABSTRACT

A photosensitive film assembly comprising;

a polymeric support having first and second side, said support being reflective to non penetrating radiation; and a photosensitive layer on at least one of said first and second sides of said support.

9 Claims, 2 Drawing Sheets

PHOTOSENSITIVE FILM ASSEMBLY HAVING REFLECTIVE SUPPORT

FIELD OF THE INVENTION

This invention relates in general to photosensitive film assembly and more particularly to photosensitive film assembly having a support which is effective of non-penetrating radiation.

BACKGROUND OF THE INVENTION

Conventional photosensitive films include a transparent-polymeric support coated on one or both sides with photosensitive emulsion layers. After the film is developed, it can be viewed by transmitting light through the transparent film. Photosensitive films can be exposed directly to a projected radiographic image or be exposed as part of a film/screen combination. Autoradiography includes the image capture of ionizing radiation emitted by radioactive isotopes placed in contact with or in near proximity of a photosensitive film or photosensitive film/screen combination. Luminescent imaging includes the image capture of light spontaneously emitted by elements placed in contact with or in near proximity to a photosensitive film.

A problem arises when transparent film image is digitized. Traditionally, film on a transparent support has been measured using transmission optics. Because light scattered by the developed silver grain and the support and the optical complication of a double emulsion create losses in image spatial resolution, a highly collimated light beam (laser) and detector optics having a high numerical aperture are essential to digitize film density. Associated instruments are expensive and necessarily slow.

There is thus a need for a photosensitive film, such as radiographic film, which is optimized for digitization, speed, and resolution.

SUMMARY OF THE INVENTION

According to the present invention, there is provided a solution to the aforesaid problems of the prior art.

According to a feature of the present invention, there is provided a photosensitive film assembly comprising;

a polymeric support having first and second side, said support being reflective to non penetrating radiation; and a photosensitive layer on at least one of said first and second sides of said support.

ADVANTAGEOUS EFFECT OF THE INVENTION

The invention has the following advantages.

1. Photosensitive assembly is optimized for digitization.
2. Photosensitive assembly is optimized for speed.
3. Photosensitive assembly is optimized for resolution.

DETAILED DESCRIPTION OF THE INVENTION

The invention has been described in detail with particular reference to certain preferred embodiments thereof, but it will be understood that variations and modifications can be effected within the spirit and scope of the invention.

Figure 1:
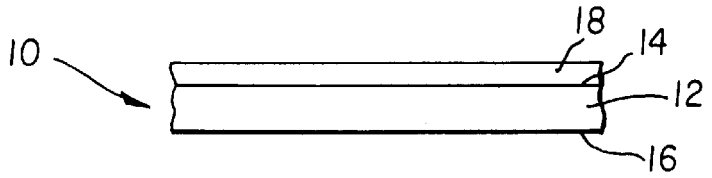
FIGS. 1–4 are diagrammatic, sectional views of embodiments of the photosensitive assembly of the present invention.

Referring now to FIGS. 1–4, there are shown embodiments of the photosensitive film assembly of the present invention. FIG. 1 shows a photosensitive film assembly 10 including a polymeric support 12 with first and second sides 14 and 16 and a photosensitive layer on side 14. Polymeric support 12 is opaque to and reflective of non penetrating radiation such as light. Polymeric support 12 preferably includes a white polymeric support layer (i.e., polyester) including barium sulfate. Photosensitive layer 18 includes a high-speed emulsion such as a green-sensitized, polydisperse –4.0 micrometers, silver bromide t-grain emulsion. Photosensitive layer 18 could also be on side 16.

Central to the design of this system is the film support. The film support user is barium sulfate filled polyester, commercially available from ICI under the trade name Melinex. The features of the support that directly relate to this invention are:

highly reflectivity to nominal white light low internal transmission efficient blue-light fluorescence stimulated by Uva high extinction/low penetration of Uva light The preferred film is manufactured in a manner that is reasonably identical to that of radiographic film. The support is commercially available in a coatable form, at a nominal thickness of 7 mil., a thickness that lends itself well to automated processing. Due to the green-light sensitivity of this emulsion, special darkroom filters (or total darkness) must be used.

Figure 2:
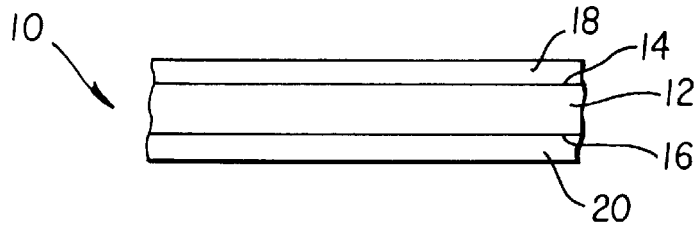

FIG. 2 shows a photosensitive film 10 having reflective polymeric support 12 with first and second sides 14 and 16, photosensitive layer 18 on side 14 and photosensitive layer 20 on side 16. Photosensitive layers 18 and 20 can be of the same or different emulsions, but are preferably of the same emulsion.

Where the photosensitive film assembly of FIG. 1 or FIG. 2, is used to record a radiographic image directly, support 12 is transmissive of penetrating radiation, (such as X-rays, gamma rays, etc.).

Figure 3:
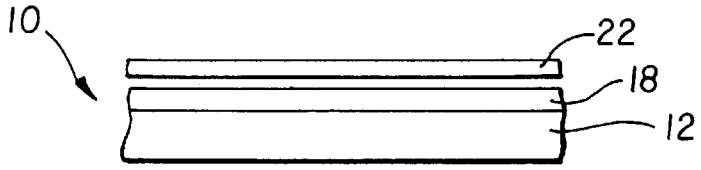
Figure 4:
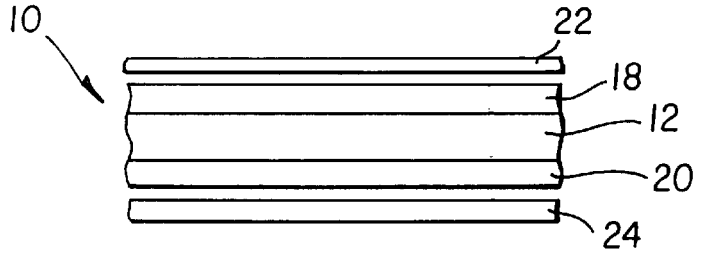

FIGS. 3 and 4 show embodiments where image conversion screens are used to convert penetrating radiation images (e.g., X-ray image, autoradiographic images) into light images which expose the photosensitive layer(s) of assembly 10. As shown in FIG. 3, the photosensitive film assembly of FIG. 1, further includes an image conversion screen 22, while as shown in FIG. 4, the photosensitive film assembly 10 further includes image conversion screens 22 and 24. Screens 22 and 24 include a high speed phosphor such as Gadolinium Oxysulfide: Terbium (GOS) which spectrally matches the film emulsion sensitivity of layers 18 and 20.

The assemblies described above can be contained in a cassette for exposure.

Figure 5:
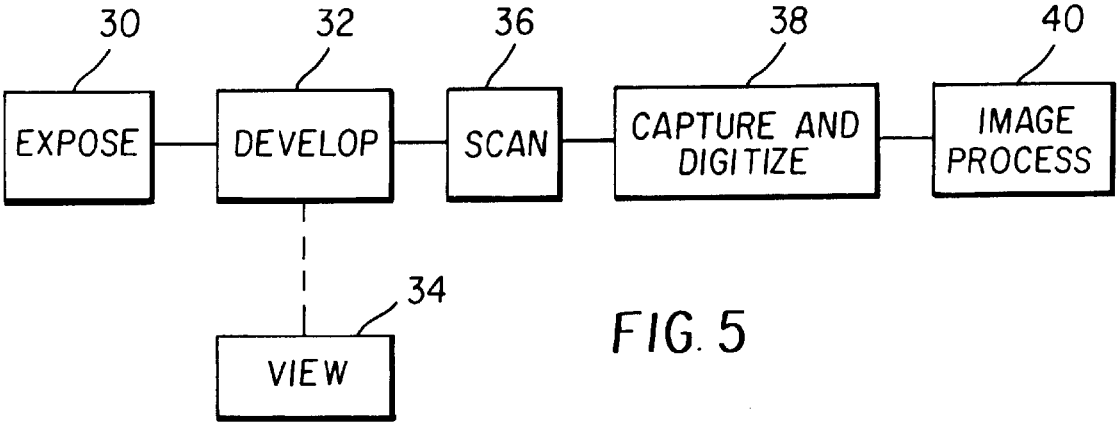
FIG. 5 is a block diagram of an imaging system incorporating the present invention.

FIG. 5 shows use of the film assembly of the present invention. As shown, the film assembly is exposed (box 30) to produce latent images in the emulsion layer(s). The film assembly is developed (box 32) by known film developing techniques. The developed film can be viewed as a document with extant backlighting (box 34). The film contrast may be enhanced for viewing with ultraviolet (Uva) light backlighting which causes the barium sulfate to fluoresce (blue light) with very high efficiency. Alternatively, the film may be conveniently digitized by reflective scanning (box 36) preferably using blue light. The contrast (dynamic range of response) may be significantly enhanced by reflective scanning with Uva illumination and blue light detection. The scanned light image is captured and digitized (box 38).

If the film has double coated emulsion layers (FIG. 2), the two images are substantially independent measure of the same radiographic image. Upon digitization of each scanned image, the images may be processed (box 40) with appropriate software to verify the significance of features of interest (e.g., eliminating emulsion artifacts).

The operating principles responsible for the speed, resolution and improved digitization imparted by the film and film/screen combinations of FIGS. 1–4 are now explained.

1. The minimization of the combined path length of ionizing radiation and screen photons productive to the process of imparting the latent image in the film emulsion Without the use of a phosphor screen, projected X-rays or isotopic emissions primarily interact with the photographic emulsion(s). Given that suitable accommodations are made within the film enclosure (cassette) to minimize radiation scatter and attenuation, the highest spatial resolution in the image is expected from such a "direct" exposure of the film to radiation. Using appropriate, very thin phosphor screens film speed is enhanced at some expense to spatial resolution. A large speed gain is assured by the film emulsion being intimately sandwiched between highly reflective surfaces. The loss of resolution is much less than is generally observed for films having clear support, because the optical path of any photon entering the barium sulfate-filled plastic support is minimal. Most of light promptly returns to the film emulsion, increasing speed with little impact upon resolution. By contrast, alternative white film supports (e.g., titanium oxide filled polyester) permit a longer optical path and demonstrate inferior performance. A relatively small amount of green light (<8%) does penetrate the preferred film base used in the model system. Such crosstalk between support sides may compromise the film/screen performance significantly in the case of double-sided white film; thicker supports are available to reduce crosstalk. Further, the small amount of barium sulfate fluorescence induced by ionizing radiation contributes little (about 1%) to film speed or diminution of spatial resolution of the preferred film/screen configuration; however, it has a more significant impact upon the preferred film speed when the system in used without a screen.

2. The minimization of optical path of the light used to measure (digitized) film density.

Figure 6:
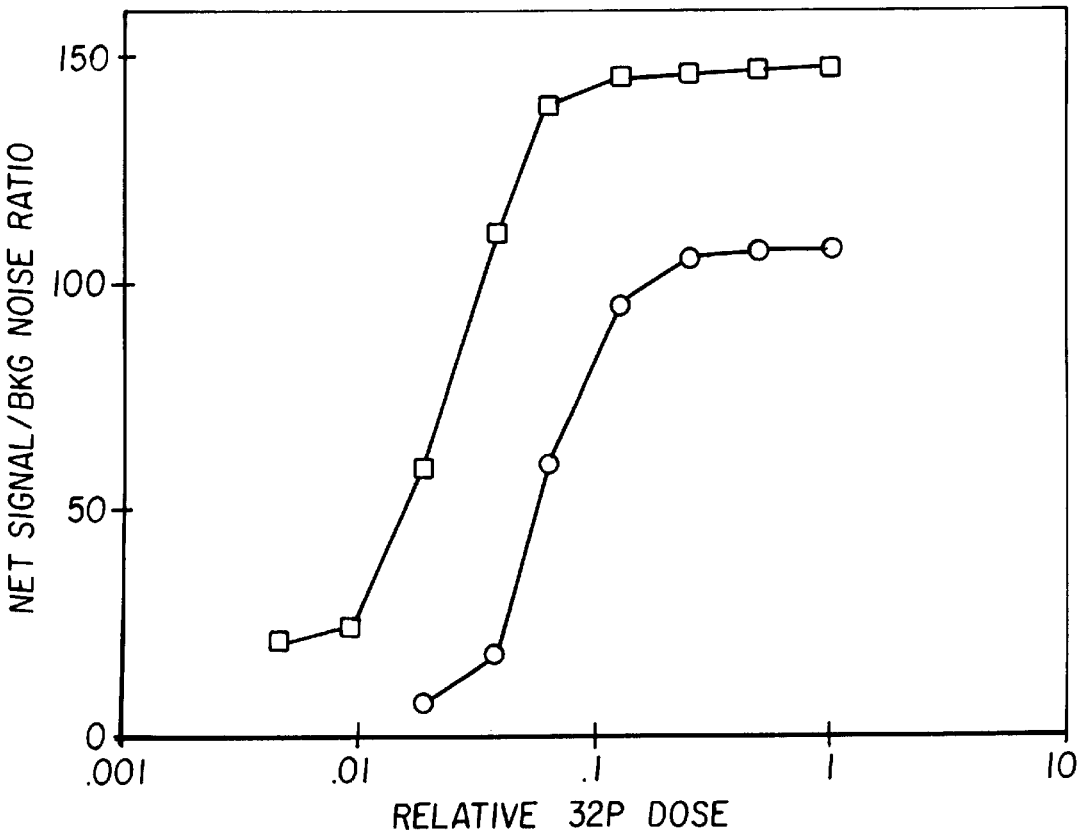
FIG. 6 is a graphical view useful in explaining the advantages of the present invention.

Traditionally, film on clear support has been measured using transmission optics. Because light scattered by the developed silver grain and the support and the optical complication of a double emulsion create losses in image spatial resolution, a highly collimated light beam (laser) and detector optics having a high numerical aperture are essential to digitized film density. Associated instruments are expensive and necessarily slow. By contrast, bar scanning devices for digitizing documents are inexpensive and fast, but are capable of digitizing at high resolution in the reflectance mode only. Using the preferred film support, a spatial resolution of greater than 5 line-pairs per millimeter is readily achieved at a precision of measure of 10 bits. Greater precision and spatial resolution can be obtained by reflective scanning of this film with Uva illumination and blue light detection. Using a higher precision CCD camera with a blue filter, and Uva epi-illumination of the film, a spatial resolution of greater about 10 line pairs per millimeter and 12-bits of precision has been demonstrated. This is made possible because of the marked reduction of the optical path of photons that are productive in the image digitization. A Uva photon is scattered or extinguished by a silver grain in its initial flight through a developed emulsion layer. If a photon does reach the film support, it is efficiently absorbed by barium sulfate and yields a blue photon (400–500 nm) with prompt and efficient fluorescence; estimated fluorescence intensity yield of the preferred support is about 40%. Upon emission from the support material, blue light returns through the emulsion, becoming scattered or extinguished by developed silver grains. The combined optical paths of illuminating and emitted photons include two passes through the photographic emulsion; consequently, the apparent emulsion density is approximately twice that which would be measured by transmission through a single emulsion. Greater than a 2× density is anticipated, since the preferred Uva/blue light will be scattered/extinguished more than the currently used red laser light (see FIG. 6). In contrast to idealized transmission densitometry, all photons involved in the preferred process of camera digitization are scattered, extinguished or are secondary fluorescent photons directed randomly through the emulsion. Photons that are productive to the imaging/digitization process are observed at a high numerical aperture at a distance that diminishes the imaging haze that is consequential to the scattering interactions. As a result, the image of the film that is digitized reduces the measurement to only those photons that traverse the single emulsion at random angles (Lambertian), and do so twice. A practical estimate of 10 line pairs spatial resolution can be made.

3. Enhanced speed of the preferred film/screen is clearly demonstrated for an autoradiographic exposure and analysis shown in FIG. 6. The data shown confirms a 4× speed enhancement of the preferred film compared to the same emulsion coated as a double-sided clear film. Film density measures were performed for the preferred film as discussed above (2), and the clear film measures were performed with green light transmission. The preferred emulsion used for this comparison exists in a clear, double-sided film commercially available from Eastman Kodak, known as BioMax MS. It is demonstrably 5–10× the speed of other radiographic films. Preliminary tests using radiographic systems have confirmed that the preferred film/screen system is at least 20× the speed of currently used radiographic films, which is consistent with the above estimates. The preliminary radiographic tests were assessed visually by a professional radiography without using the preferred measurement system (Uva/blue light) which enhances apparent speed. It is clear from the supporting analytical graphs (FIG. 6), that the measured signal-to-noise ratios of the preferred film images are greater by about 37% than that of clear film. Examination of the response profiles suggest that roughly the same image "contrast" exist between the film, but the preferred film offers greater latitude upon implementing the preferred measurement. It is likely, therefore, that apparent film density will conform to a simple doubling (as discussed in 2, above) for an exposure increment, but the available density domain of useful data will be increased.

The operative principle of comparing two sides of white film is to examine the coincidence of image features after having exposed (with penetrating radiation) and processed a double-sided white film. Since the two sides of the film contain nearly identical image information in perfect registration, the two processed sides need only be digitized identically—obviously, the symmetry of one image must be flipped to achieve identity. Since Uva illumination does not substantially penetrate the film support, the two digitized images are essentially independent measures of the same image, and the identical image data files may be compared with extant computed algorithms. Examples and capabilities of software that may be of some value are:

the computed photometric maximum of two digital images may present an image that is substantially artifact free, since most processed film artifacts originate from emulsion abrasions or stray light that cause an exposure.

the computed photometric minimum of two digital images may present an image that is free of artifacts that include the insufficient processing or lack of emulsion.

the computed sum or average of the two digital files will present a higher quality image data file, the quantitative significance of each and all points (pixels) of which are √2 or 41% higher than any one image, effectively extending the dynamic range (single-to-noise) by the same factor.

arithmetically combining the computed photometric maximum (or minimum) with the computed average provides a simplified method of identifying, examining or measuring image artifacts.

The invention has been described in detail with particular reference to certain preferred embodiments thereof, but it will be understood that variations and modifications can be effected within the spirit and scope of the invention.

PARTS LIST

10 photosensitive film assembly
12 support
14,16 first and second sides
18 photosensitive layer
20 photosensitive layer
22,24 image conversion screens
30 expose
32 develop
34 view
36 digitize
38 capture and digitize
40 image process

What is claimed is:

1. A photosensitive film assembly comprising;

a polymeric support having first and second side, said support being reflective to non penetrating radiation; and a photosensitive layer on at least one of said first and second sides of said support.

2. The photosensitive film assembly of claim 1 including first and second photosensitive layers respectively on said first and second sides of said support.

3. The photosensitive film assembly of claim 2 wherein said support is transmissive of penetrating radiation and said first and second photosensitive layers are directly exposed by an image of penetrating radiation.

4. The photosensitive film assembly of claim 1 wherein said photosensitive layer comprises a green-sensitized, polydisperse −4.0 MM, silver bromide t-grain layer.

5. The photosensitive film assembly of claim 2 wherein said first and second photosensitive layers comprise a green-sensitized, polydisperse −4.0 MM, silver bromide t-grain layer.

6. The photosensitive film assembly of claim 1 wherein said support includes a white reflective material.

7. The photosensitive film assembly of claim 6 wherein said white reflective material includes barium sulfate.

8. The photosensitive film assembly of claim 1 including a first screen adjacent to said photosensitive layer for converting a penetrating radiation image to a light image which exposes said photosensitive layer.

9. The photosensitive film assembly of claim 1 including a first and second screens respectively adjacent to said first and second photosensitive layers for converting a penetrating radiation image to light images which respectively expose said first and second photosensitive layers.

* * * * *